US010506331B2

(12) United States Patent
Baird et al.

(10) Patent No.: US 10,506,331 B2
(45) Date of Patent: Dec. 10, 2019

(54) COAXIAL LOUDSPEAKER

(71) Applicants: MARTIN AUDIO LIMITED, High Wycombe, Buckinghamshire (GB); Jason Baird, London (GB); Philip Anthony, Marlow, Buckinghamshire (GB)

(72) Inventors: Jason Baird, London (GB); Philip Anthony, Marlow (GB)

(73) Assignee: Martin Audio Limited, Buckinghamshire (GB)

( * ) Notice: Subject to any disclaimer, the term of this patent is extended or adjusted under 35 U.S.C. 154(b) by 0 days.

(21) Appl. No.: 16/061,789

(22) PCT Filed: Dec. 14, 2016

(86) PCT No.: PCT/GB2016/053939
§ 371 (c)(1),
(2) Date: Jun. 13, 2018

(87) PCT Pub. No.: WO2017/103589
PCT Pub. Date: Jun. 22, 2017

(65) Prior Publication Data

US 2018/0367888 A1 Dec. 20, 2018

(30) Foreign Application Priority Data

Dec. 14, 2015 (GB) ..... 1522021.3

(51) Int. Cl.
*H04R 1/24* (2006.01)
*H04R 1/26* (2006.01)
(Continued)

(52) U.S. Cl.
CPC ..... *H04R 1/24* (2013.01); *H04R 1/26* (2013.01); *H04R 1/30* (2013.01); *H04R 9/06* (2013.01)

(58) Field of Classification Search
CPC . H04R 1/30; H04R 1/345; H04R 1/24; H04R 1/2857; H04R 2201/34;
(Continued)

(56) References Cited

U.S. PATENT DOCUMENTS 2,761,913 A 9/1956 Manley
4,706,295 A 11/1987 Putnam et al.
(Continued)

FOREIGN PATENT DOCUMENTS

GB 701395 A 12/1953
GB 2054323 A 2/1981
(Continued)

OTHER PUBLICATIONS

International Search Report issued in PCT/GB2015/051205 dated Apr. 9, 2015 (3 pages).
(Continued)

*Primary Examiner* — Curtis A Kuntz
*Assistant Examiner* — Julie X Dang
(74) *Attorney, Agent, or Firm* — Harness, Dickey & Pierce, P.L.C.

(57) ABSTRACT

A coaxial loudspeaker apparatus (10) comprising: a first unit, being arranged to propagate sound in a first frequency range; a second unit, being arranged to propagate sound in a second frequency range that is higher than the first frequency range, comprising a first waveguide (30); a second waveguide (60) arranged to extend substantially in prolongation of the first waveguide (30); and a third waveguide (100) arranged to extend substantially in prolongation of the second waveguide (60).

25 Claims, 15 Drawing Sheets

(51) Int. Cl.
*H04R 1/30* (2006.01)
*H04R 9/06* (2006.01)

(58) Field of Classification Search
CPC ..... H04R 1/023; H04R 1/227; H04R 1/26; H04R 1/2819; H04R 1/2834; H04R 1/2842; H04R 1/2853; H04R 1/288; H04R 1/323; H04R 1/403; H04R 2201/403; H04R 2307/207
USPC ..... 381/340, 339, 337, 338; 181/185, 184, 181/192, 152
See application file for complete search history.

(56) References Cited

U.S. PATENT DOCUMENTS

| | | | | |
|---|---|---|---|---|
| 6,704,425 | B1 * | 3/2004 | Plummer | H04R 1/2819 381/339 |
| 8,831,270 | B1 | 9/2014 | Dimitrov | |
| 9,967,652 | B2 * | 5/2018 | Baird | H04R 1/24 |
| 2004/0190736 | A1 * | 9/2004 | Gelow | H04R 1/34 381/182 |
| 2006/0285712 | A1 * | 12/2006 | Butler | H04R 1/24 381/340 |
| 2010/0272295 | A1 | 10/2010 | Nakatani | |
| 2011/0069857 | A1 | 3/2011 | Miller et al. | |
| 2013/0064414 | A1 | 3/2013 | Flavignard et al. | |
| 2013/0142379 | A1 | 6/2013 | Varla et al. | |
| 2014/0286524 | A1 * | 9/2014 | Robineau | H04R 1/24 381/412 |

FOREIGN PATENT DOCUMENTS

| | | | |
|---|---|---|---|
| GB | 2139040 | A | 10/1984 |
| GB | 2525407 | A | 10/2015 |
| WO | WO-2009109228 | A1 | 9/2009 |
| WO | WO-2015162432 | A1 | 10/2015 |

OTHER PUBLICATIONS

Written Opinion issued in PCT/GB2015/051205 dated Apr. 9, 2015 (8 pages).
Search Report for Application No. GB 1407171.6 dated Sep. 26, 2014 (1 page).
International Search Report and Written Opinion issued in PCT/GB2016/053939, dated Mar. 2, 2017; ISA/EP.
UK Search Report of the Intellectual Property Office issued in Application No. GB 1522021.3, dated Jun. 24, 2016.

* cited by examiner

COAXIAL LOUDSPEAKER

The present invention relates to a loudspeaker apparatus and, in particular, to so called 'coaxial' loudspeakers. The invention also extends to a waveguide member for a coaxial loudspeaker.

A coaxial loudspeaker design offers a compact acoustic arrangement that improves system directivity through the crossover region, by avoiding the off-axis phase cancellation that occurs with discrete, axially offset acoustic sources.

However, it is recognised that coaxial loudspeakers often suffer from a compromised directivity pattern (acoustic response off-axis) across their frequency spectrum. In particular, when a conventional, axisymmetric cone shape is used as the low/mid-frequency part of the coaxial loudspeaker arrangement, the directivity of the high-frequency section is compromised because the axisymmetric low/mid-frequency cone forms the walls of a horn within which the high-frequency sound waves propagate, so an axisymmetric directivity pattern is imposed upon the high-frequency acoustic output. This axisymmetric directivity pattern is generally not optimal for professional loudspeakers. Also, because the angle of the cone neck must be steep in order to ensure good low/mid-frequency performance, the axisymmetrical high frequency directivity pattern often has a beamwidth which decreases with increasing frequency, further compromising the design.

Attempts to improve the directivity of coaxial loudspeakers, whilst maintaining compactness, may introduce further effects that act to impair acoustic performance; for example, by occluding acoustically active elements of the loudspeaker (the low/mid-frequency cone) or diffusing sound in a rudimentary and uncontrolled manner.

It is an aim of the present invention to alleviate at least some of the aforementioned problems.

The present invention relates to a coaxial loudspeaker apparatus comprising: a first unit, being arranged to propagate sound in a first frequency range; a second unit, being arranged to propagate sound in a second frequency range that is higher than the first frequency range, comprising a first waveguide; a second waveguide arranged to extend substantially in prolongation of the first waveguide; and a third waveguide arranged to extend substantially in prolongation of the second waveguide.

Preferably, the second waveguide is provided on the first unit, and more preferably on the moving parts of the first unit, and still more preferably in such a way that the second waveguide is affixed/bonded to the first unit. Preferably, the first unit comprises a cone for reproducing sound, wherein the second waveguide is provided on the cone, for example in such a way that it is affixed/bonded to, or integral with, the cone.

Advantageously, in this way an enlarged effective waveguide is provided for the second unit, thereby improving efficiency and performance of the second unit.

Preferably, the second waveguide and the third waveguide are respectively arranged to extend substantially in prolongation of the first waveguide and second waveguide in a downstream direction.

Preferably, the first unit is also arranged to extend substantially in prolongation of the first waveguide in a downstream direction.

The first waveguide and the third waveguide may be fixed. The second waveguide may be arranged to move relative to the first waveguide and/or relative to the third waveguide.

For optimum performance and as though a single waveguide were present, preferably the third waveguide extends substantially continuously from the second waveguide and wherein the second waveguide extends substantially continuously from the first waveguide. Preferably, the first unit also extends substantially continuously from the first waveguide.

So as not to impede operation of the first unit, preferably the second waveguide is arranged to move in unison (and preferably always to move in unison) with the first unit in operation.

Preferably, the first waveguide, second waveguide and/or the third waveguide are coaxial (and/or preferably concentric).

Preferably, the first unit comprises a cone or other sound reproducing diaphragm and wherein the second unit comprises a driver unit that is arranged upstream of the cone (or other sound reproducing diaphragm); in this way occlusion of the first unit by the second unit is reduced.

The first unit may comprise only one, preferably single, cone or other sound reproducing diaphragm. Preferably, the second unit comprises a horn, a dome and/or a cone or other sound reproducing diaphragm.

Preferably, the first waveguide comprises a mouth located at a junction with the second waveguide; a throat located acoustically upstream; and a passage extending between the mouth and the throat.

Preferably, the third waveguide is arranged to extend substantially, and preferably directly, in prolongation of at least a portion of the first unit, preferably in a region where no second waveguide is provided. Preferably, the third waveguide is arranged to extend substantially, and preferably directly, in prolongation of a portion of the first unit and of the second waveguide.

Preferably, the third waveguide comprises a convex-shaped lip, preferably wherein the convex-shaped lip overhangs directly downstream of (preferably "above") the first unit.

In order not to hinder the acoustic performance of the first unit, preferably the third waveguide includes at least one aperture for allowing sound from the first unit to pass through the third waveguide.

Preferably, the at least one aperture is arranged directly downstream of the first unit, and more preferably wherein every aperture is arranged directly downstream of the first unit.

Preferably, the third waveguide extends, in the downstream direction, laterally away from the second unit.

Preferably, the third waveguide further comprises a peak at a most downstream point of the third waveguide. Preferably, the third waveguide further comprises a trough extending in an upstream direction, laterally away from the peak and from the second waveguide. Preferably, the peak is the most downstream point of the third waveguide that is local to or most proximate to the second unit. Preferably, the trough has a concave profile. Preferably, the third waveguide has a substantially sinusoidal profile.

Preferably, the third waveguide is provided with a smooth and continuous surface, preferably extending at least from a junction between the third waveguide and the second waveguide and extending to the peak.

The at least one aperture may be provided on the third waveguide laterally away from the peak and the second unit, and preferably the at least one aperture is only provided on the third waveguide laterally away from the peak and the second unit.

Optionally, the at least one aperture is provided on the trough, and preferably only on the trough. Preferably, the third waveguide and the second waveguide are separated. Preferably, the third waveguide is arranged such that the third waveguide does not prevent travel of the first unit and/or the second waveguide, preferably by being separated from one another by an appropriate distance.

Preferably, the third waveguide is separated from the second waveguide by a constant distance, preferably across their entire junction.

Preferably, the second waveguide is arranged as a portion of a truncated conical surface. Preferably, there is provided a hollow region between the cone and the second waveguide, preferably wherein the hollow region is entirely enclosed.

Preferably, there is provided a cavity in a region bound by the first unit (and preferably, specifically the cone), the second waveguide and the third waveguide.

Preferably, the third waveguide comprises a flange arranged opposite the second waveguide, thereby arranged to provide an acoustic duct connecting the cavity with a region outside of the cavity and preferably downstream of the second waveguide.

The flange may extend towards the cone and the flange may extend parallel to the second waveguide. Preferably, the acoustic duct (also preferably referred to as an "acoustic duct" or "acoustic channel") is arranged to reduce resonance within the cavity.

Optionally, the second waveguide is less dense than the moving parts (preferably the cone) of the first unit, preferably wherein the second waveguide and/or the first unit is formed from paper, fibreglass, fabric and/or composite materials.

Suitably, the third waveguide is denser than the second waveguide. Preferably there is provided at least two: first waveguides; second waveguides; and/or third waveguides. Optionally, the at least two first waveguides, the at least two second waveguides and/or the at least two third waveguides are arranged on (preferably, meaning "aligned in") a plane that bisects the first unit.

Preferably, the at least two second waveguides and the at least two third waveguides are arranged on opposite lateral sides of the second unit. Optionally, the first waveguide, second waveguide and/or third waveguide are axially asymmetric.

The first waveguide, second waveguide and/or third waveguide may be shaped to produce differential acoustic dispersion. The second unit may comprise an effective mouth provided by a lateral distance between the peaks of the static waveguide.

Preferably, the first unit, and more preferably the cone, is the most downstream sound reproducing member of the apparatus. Preferably, the second unit is the most upstream sound reproducing member of the apparatus.

Preferably, sound reproducing members of the apparatus consist only of the first and second units, for example there are provided only two sound reproducing diaphragm (one diaphragm forming—preferably, part of—the first unit, and the other forming—preferably, part of—the second unit).

Preferably, the first unit is anchored to a part of the apparatus other than the third waveguide, and preferably other than the first waveguide also.

Preferably, the most proximate parts of the first and third waveguide are laterally set apart from one another, preferably by a distance that is at least equal to the lateral extent of the second waveguide According to another aspect of the invention, there is provided a loudspeaker incorporating the coaxial loudspeaker apparatus as described above, preferably, wherein the loudspeaker is arranged as a monitor speaker.

According to another aspect of the invention, there is provided a waveguide member for a coaxial loudspeaker comprising a first waveguide and a second waveguide extending substantially in prolongation of the first waveguide, said waveguide member being arranged to extend substantially in prolongation of the second waveguide preferably the waveguide member being the third waveguide described above.

Preferably, the waveguide member is arranged to be fixed relative to the second waveguide, preferably wherein the waveguide member is fixed directly to the coaxial loudspeaker.

The waveguide member may include at least one aperture for allowing sound from the coaxial loudspeaker to pass through the third waveguide. The waveguide member may comprise a peak at a most downstream point of the third waveguide; and a trough at a recession, in an upstream direction, laterally away from the peak and from the second waveguide.

Optionally, the waveguide member is provided in two separate parts, preferably wherein the parts are identical. Suitably, the waveguide member is provided with a flange for forming an acoustic channel with the second waveguide when the waveguide member is in situ such that it extends substantially in prolongation of the second waveguide.

Further features of the invention are characterised by the dependent claims. The invention extends to any novel aspects or features described and/or illustrated herein. The invention extends to methods and/or apparatus substantially as herein described and/or as illustrated with reference to the accompanying drawings.

The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein. The invention also provides a signal embodying a computer program for carrying out any of the methods described herein and/or for embodying any of the apparatus features described herein, a method of transmitting such a signal, and a computer product having an operating system which supports a computer program for carrying out any of the methods described herein and/or for embodying any of the apparatus features described herein.

Any apparatus feature as described herein may also be provided as a method feature, and vice versa. As used herein, means plus function features may be expressed alternatively in terms of their corresponding structure, such as a suitably programmed processor and associated memory.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

In this specification the word 'or' can be interpreted in the exclusive or inclusive sense unless stated otherwise. Furthermore, features implemented in hardware may generally be implemented in software, and vice versa. Any reference to software and hardware features herein should be construed accordingly.

The invention extends to a coaxial loudspeaker apparatus as described herein and/or substantially as illustrated with reference to the accompanying drawings. The invention also extends to a waveguide member as described herein and/or substantially as illustrated with reference to FIGS. 1 to 5 and FIGS. 7 to 16.

The present invention is now described, purely by way of example, with reference to the accompanying diagrammatic drawings, in which:—

FIGS. 1-9 show various views and examples of a coaxial loudspeaker 10.

Figure 1:
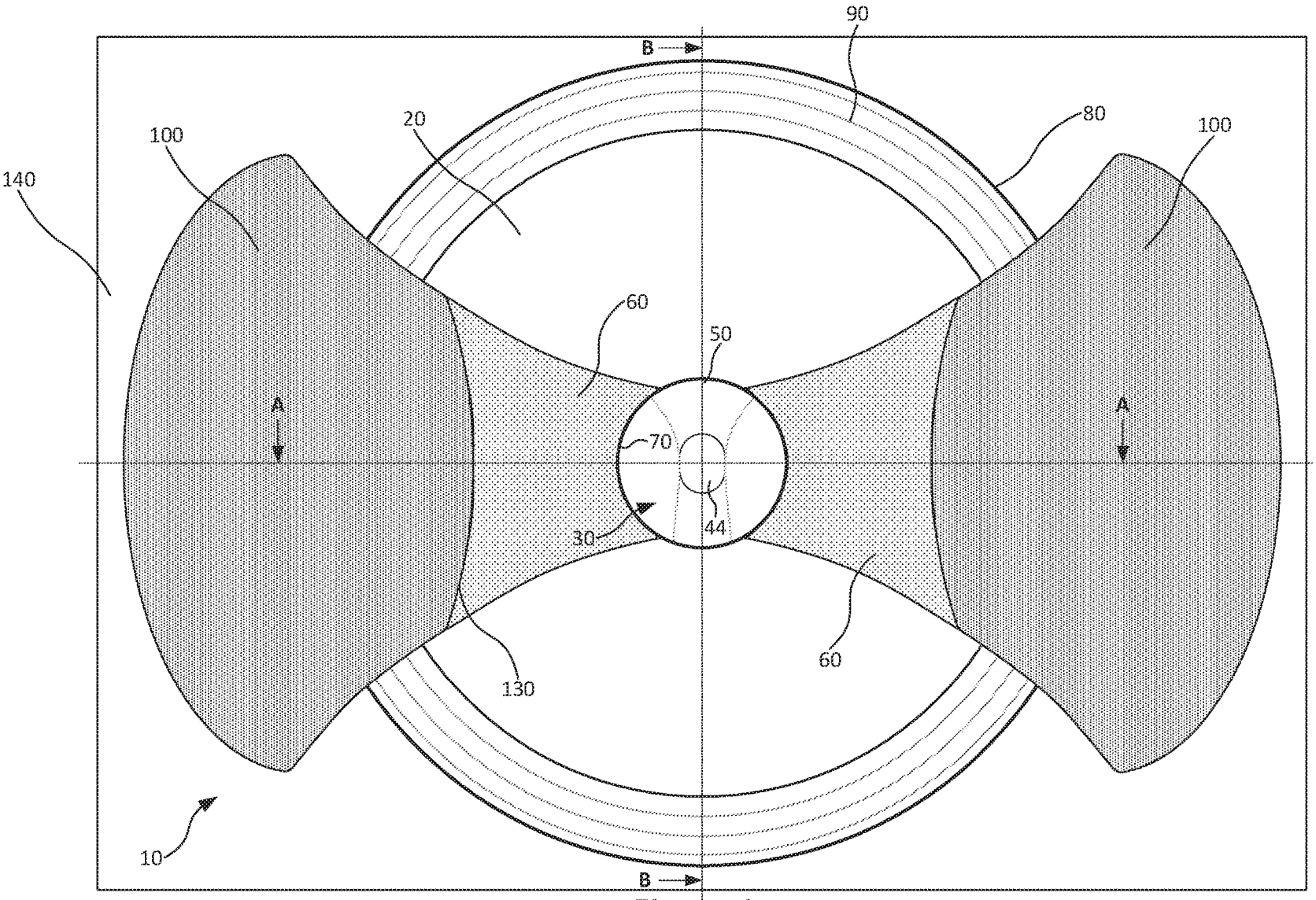
FIG. 1 shows a front view of a coaxial loudspeaker.

In more detail, FIG. 1 shows a front view of the coaxial loudspeaker 10 comprising: a low/mid-frequency unit in the form of a low/mid-frequency cone 20 or diaphragm; a high-frequency unit comprising a fixed waveguide 30 coaxial to the low/mid-frequency cone 20; and a moving waveguide 60.

Coaxial loudspeakers comprising a moving waveguide associated with a low/mid-frequency cone and a fixed waveguide associated with a high-frequency unit are described in UK Patent Application No. 1407171.6 and PCT Patent Application No. PCT/GB2015/051205, which are hereby incorporated by reference.

A principal acoustic downstream direction 122 is shown in FIG. 2, and this term is used throughout preferably to refer to a direction in which sound propagates away from the front of the coaxial loudspeaker 10, wherein the axis of the downstream direction 122 is coaxial to the low/mid-frequency cone 20 (herein referred to as the "cone" 20) and to the high frequency fixed waveguide. The term "upstream direction" as used herein preferably opposes the downstream direction 122. The term "off-axis" preferably refers to points that are perpendicularly offset from the axis of the downstream direction 122.

The term "lateral direction" is preferably applied to connote a direction perpendicular to the axis of the downstream direction 122.

In the examples shown throughout FIGS. 1-9, the fixed waveguide 30 of the high frequency unit is in the form of a fixed high frequency horn adapted to propagate pressure waves in the form of sound in a higher frequency range than the low/mid-frequency unit 20.

The fixed waveguide 30 extends from a throat 44 (as shown in FIGS. 1-5), via a passage 40, to a mouth 50.

The fixed waveguide 30 therefore defines a passage for channeling sound (in particular, sound in a higher frequency range than the sound reproduced by the cone 20, for example at 0.5 kHz-20 kHz, and more preferably at 1 kHz-20 kHz). The fixed waveguide 30 is shown as a differential acoustic dispersion horn and is composed of fibreglass, plastic or aluminium.

In more detail, the horn mouth 50 of the fixed waveguide 30 interfaces with two moving waveguides 60 at a junction 70, such that when the cone 20 is at rest there is substantially no discontinuity between the surface of the moving waveguide 60 and the fixed waveguide 30. However, in use, when the cone 20 is vibrating the moving waveguide 60 moves together with the cone 20 whilst the fixed waveguide 30 remains substantially at rest (as further described with reference to FIG. 3). The motion of the moving waveguide 60 and cone 20 is achieved by coupling the moving waveguide 60 to the cone 20 or by forming the moving waveguide 60 into, or integrally with, the cone 20. The moving waveguide 60 can therefore be considered to be a 'moving' waveguide as, in use, it is non-static.

The coaxial loudspeaker 10 further comprises a static waveguide 100, which is stationary, such that the cone 20 and the moving waveguide 60 move relative to the static waveguide, as is also the case with the fixed waveguide 30. In operation, the static waveguide 100 and the fixed waveguide 30 do not therefore move relative to one another. The static waveguide 100 is arranged coaxial to the fixed waveguide 30 and moving waveguide 60.

The moving waveguide 60 is bonded to the conic surface of the cone 20 and the voice-coil former 48 and is configured effectively to modify the shape of the frontal face of the cone 20, at least, to improve the output of the high frequency output of the horn. Likewise, the static waveguide 100 is provided for the same reason.

The fixed waveguide 30, moving waveguide 60 and static waveguide 100 form a continuation of the horn resulting in a larger effective horn 110 (albeit in three separate, but complementary, parts) having an effective mouth 120 that is defined by the lateral distance between the most downstream points of the static waveguide. The size of the effective horn 110, both in terms of its extent downstream and its lateral extent, is therefore greater than where only a fixed waveguide 30 and a moving waveguide 60 is provided.

In order to continue the first unit (specifically, for example, the cone 20, which forms part of—or is—the first unit), the static waveguide 100 is arranged to extend the shape of the moving waveguide 60, which is in turn is arranged to extend the shape of the fixed waveguide 30.

In order to prevent excessive acoustic reflection between the cone 20 and the static waveguide 100, which would greatly interfere with the low frequency output, it is desirable to minimise the extent to which the static waveguide 100 occludes the cone 20. That is, it is preferable to minimise the extent to which the static waveguide extends over and/or into the volume bound by the cone 20. As a result, the junction 130 between the static waveguide 100 and the moving waveguide 60 is arranged above, but close to, the outer suspension 90 (preferably also referred to as a "surround") of the cone 20. At the same time, the static waveguide 100 is arranged not to interfere with the travel of the cone 20.

Simultaneously, in order to prevent excessive acoustic reflection between the moving waveguide 60 and the static waveguide 100, which would greatly interfere with the high frequency output, it is desirable to minimise the distance between these waveguides at junction 130.

In order for the static waveguide 100 to remain stationary relative to the cone 20 and to the moving waveguide 60, it is fixed to the cabinet 140 within which the coaxial loudspeaker 10 is arranged. The static waveguide can be removed.

Figure 2A:
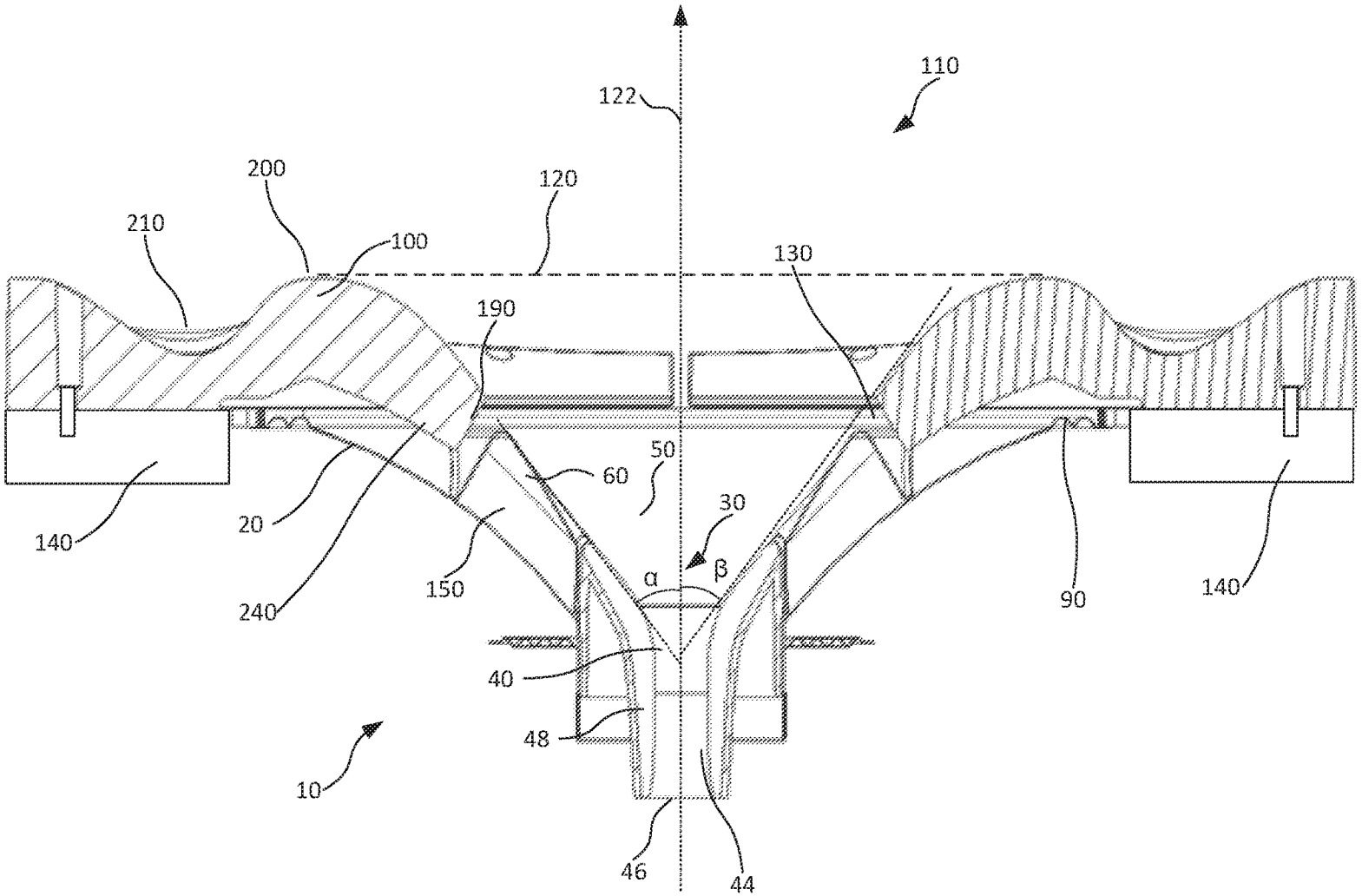
FIGS. 2 and 3 show cross sections of the coaxial loudspeaker.

FIG. 2*a* shows a cross-section of the coaxial loudspeaker 10 along the line "A" indicated in FIG. 1. The magnet assembly is not shown for conciseness.

At the junction of the fixed waveguide and the moving waveguide 70, the gradients of each waveguide are substantially identical, as demonstrated by the tangent coincident upon the terminal ends of both the fixed waveguide 30 and the moving waveguide 60, where the angle of the tangent is $\alpha$.

At the junction of the moving waveguide and the static waveguide 130, the gradients of each waveguide are also substantially identical, as demonstrated by the tangent coincident upon the terminal ends of both the moving waveguide 60 and the static waveguide 100, where the angle of the tangent is $\beta$. In the example shown, $\beta>\alpha$ in order to provide an extended horn that increases non-linearly in width in the downstream direction 122.

The moving waveguide 60 is designed to minimise its effect on the operation of the cone 20, such as the desirable cone break-up (effectively de-coupling the outer area of the cone 20 from the central area which reduces the piston diameter at high frequencies and increases the beamwidth of the output audio, compared to a rigid piston cone of the same size as the cone 20).

To minimise detriment to the oscillation of the cone 20, the moving waveguide 60 is made as lightweight as possible. Moving waveguides that are too massive, although beneficial to the high frequency output, interfere with the operation of the cone. As a result, the effective extension to the horn, by means of the presence of the moving waveguide, is limited by the desire to balance enlargement of the horn and unimpeded operation of the cone.

The static waveguide 100 comprises a lateral supporting rib 240.

Figure 2B:
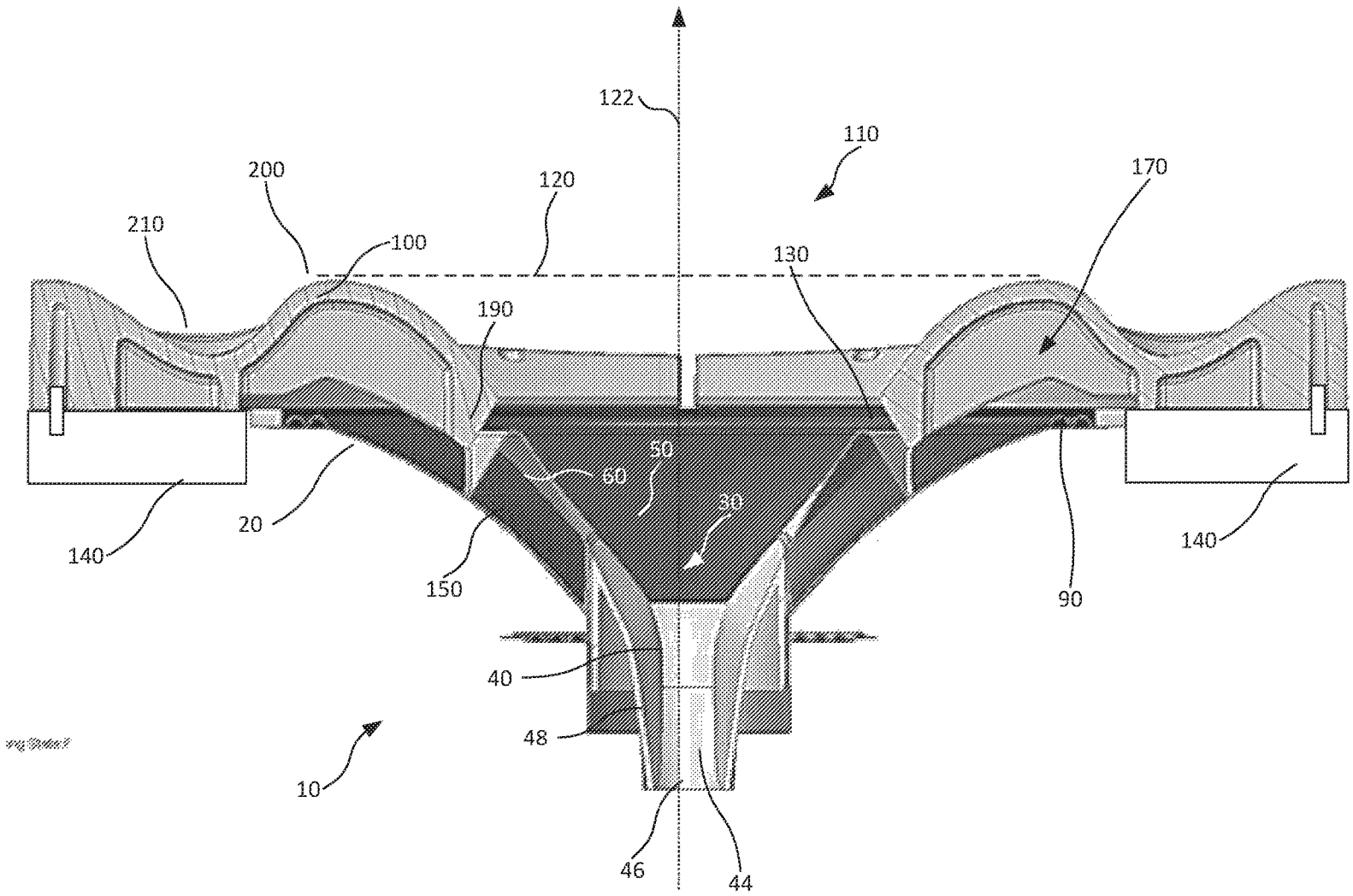

FIG. 2*b* shows a cross a cross-section of the coaxial loudspeaker 10 along a line laterally offset from the cross section line "A"; in this view, the supporting rib 240 is no longer visible.

Figure 3:
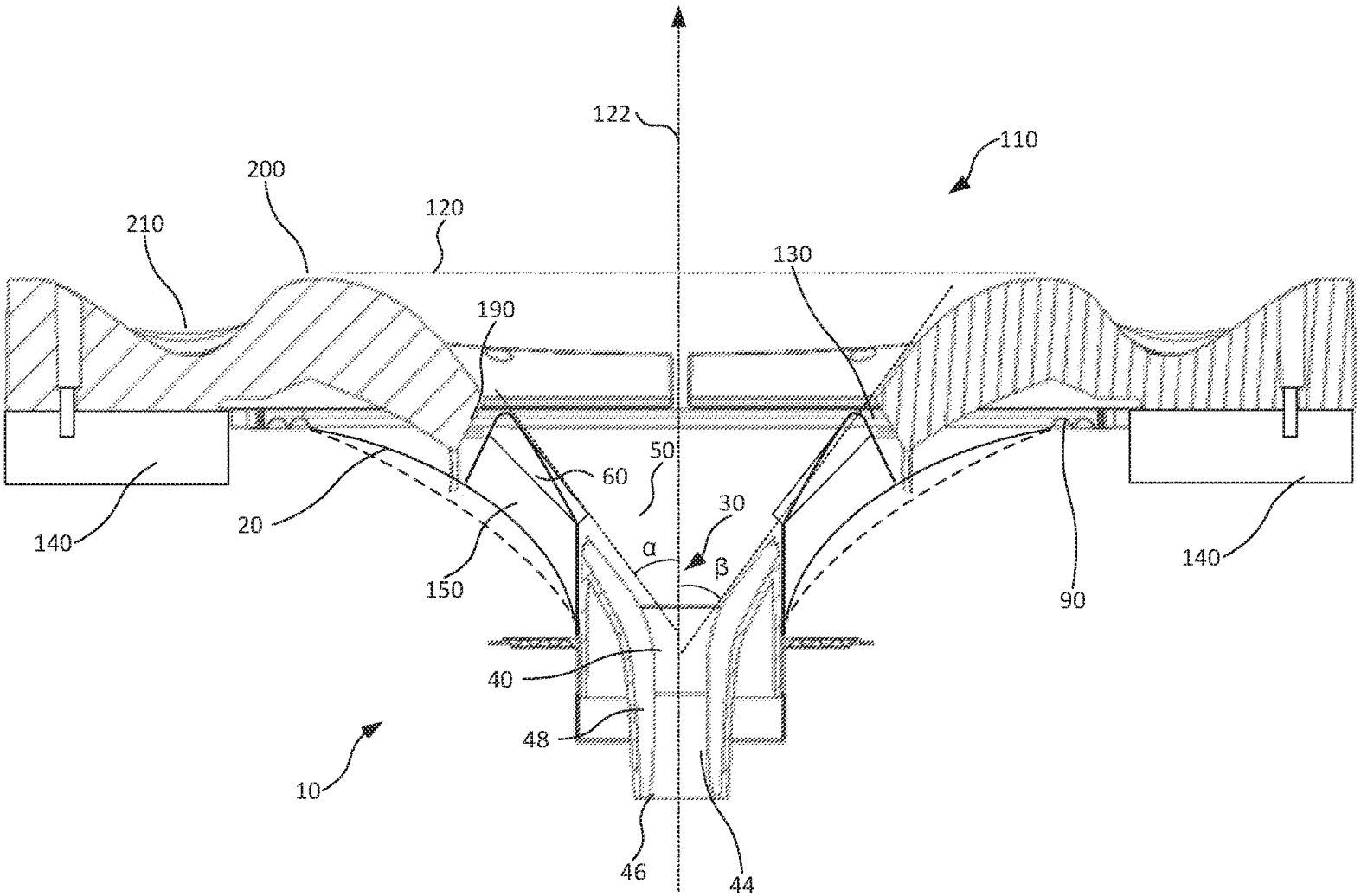

FIG. 3 shows the loudspeaker apparatus 10 in the cross-sectional view shown in FIG. 2*a* when the cone 20 is in a state where it is being driven by the low/mid-frequency voice coil 46. The cone 20 is therefore shifted in the downstream direction 122 relative to its rest position 160, as the moving waveguide 60 is free to move relative to the fixed waveguide 30.

When displaced in the downstream direction 122, the moving waveguide 60 approaches, but stays clear of, the static waveguide 100; this is in order not to affect negatively the cone's freedom to travel, which is achieved by providing a suitable clearance between the static waveguide and the moving waveguide. Even at maximal downstream displacement, the motion of the moving waveguide is not blocked by the static waveguide. For example, the clearance is preferably 0.3 cm to 5 cm, and more preferably 0.5 cm to 3 cm, at rest.

The shape of the moving waveguide 60 is based on a truncated conical surface. The moving waveguide is hollow; a cavity 150 is therefore present between the cone 20 and the moving waveguide 60 (as best seen in FIG. 2).

Figure 6:
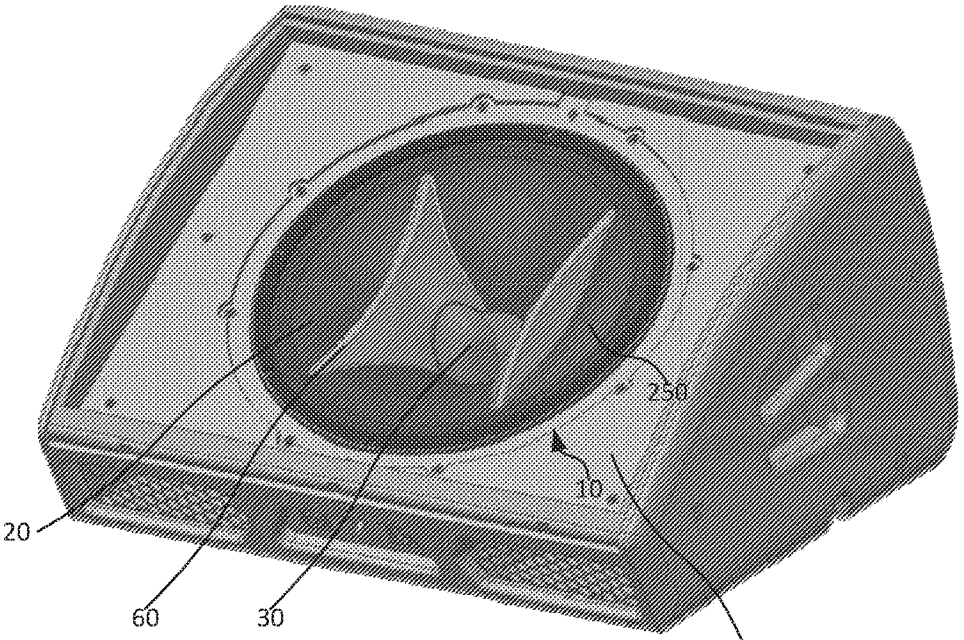
FIG. 6 shows a monitor speaker comprising a portion of the coaxial loudspeaker.

FIG. 6 shows a coaxial speaker 10 without a static waveguide 100, but only comprising the moving waveguide 60 and the fixed waveguide 30.

A hollow region—cavity 170—is provided, as defined by the region bound by the static waveguide 100, the moving waveguide 60 and the cone 20, as best seen in FIG. 2*b*.

Figure 4:
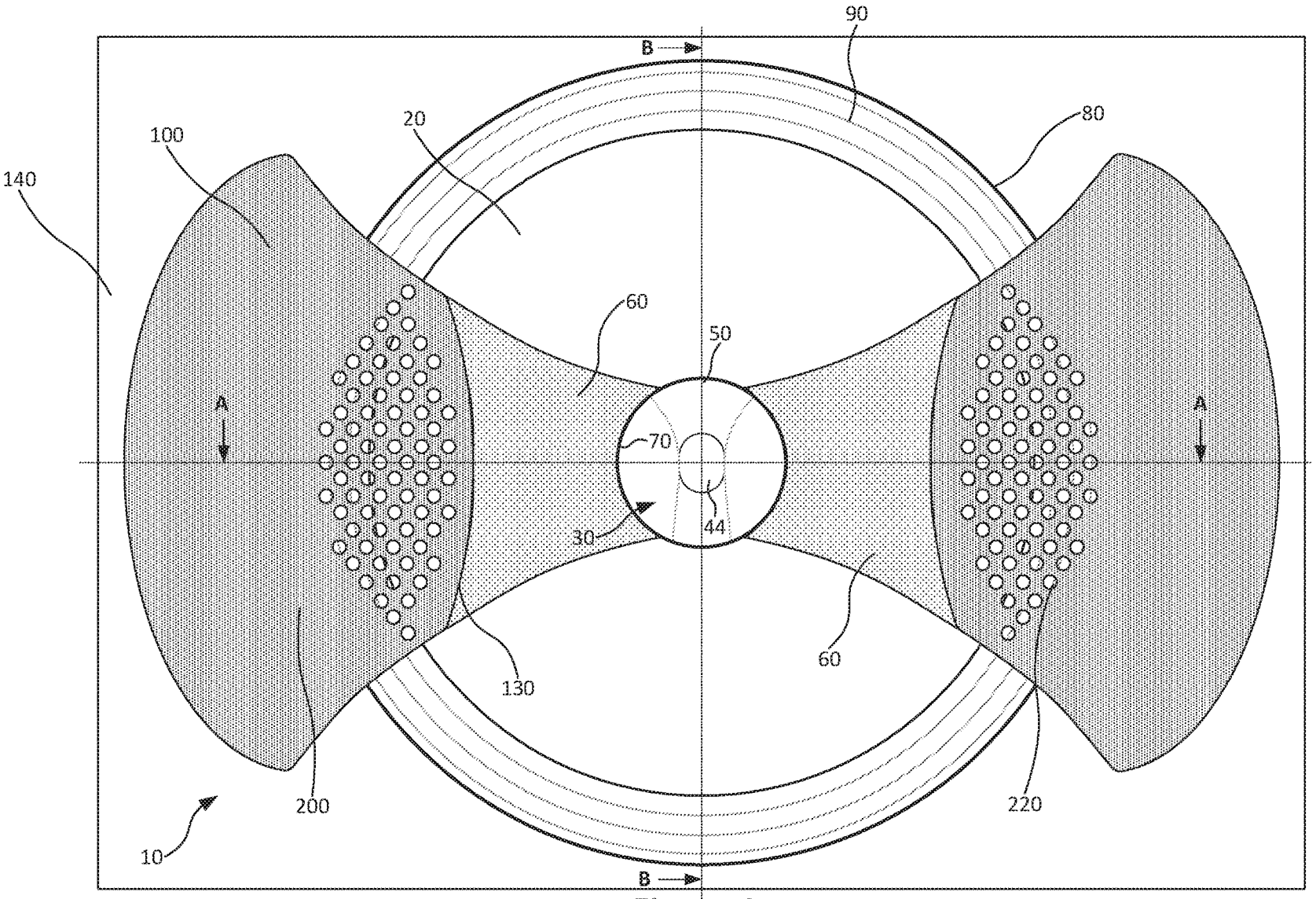
FIG. 4 is a front view of a further example of the coaxial loudspeaker.

As best seen in FIGS. 1, 4 and 5, the static waveguide 100 is arranged to mimic the lateral curvature of the moving waveguide 60 at its junction 130 with the moving waveguide.

There are provided, as part of the coaxial loudspeaker 10, two static waveguides 100, two moving waveguides 60, and two fixed waveguides 30.

In regions where there is no moving waveguide provided on the cone 20, the static waveguide 100 is instead shaped to continue the curvature of the cone, thereby enlarging the cone in order to improve its efficiency.

Arrangement of the Coaxial Loudspeaker for Differential Dispersion

In order to improve acoustic output, in particular in order to output a more consistent frequency response and SPL (Sound Pressure Level) over a given space, the coaxial loudspeaker 10 is arranged to provide differential dispersion.

The differential dispersion of sound is provided selectively to modify, in the downstream direction 122, the lateral throw pattern from the coaxial loudspeaker. In particular, the fixed waveguide 30, moving waveguide 60 and static waveguide 100 are shaped to effect differential dispersion of sound from the horn by modifying the sound propagating surfaces.

In order to provide differential dispersion, the coaxial loudspeaker 10 is provided with axially asymmetric (about the downstream axis 122) waveguides.

Figure 5B:
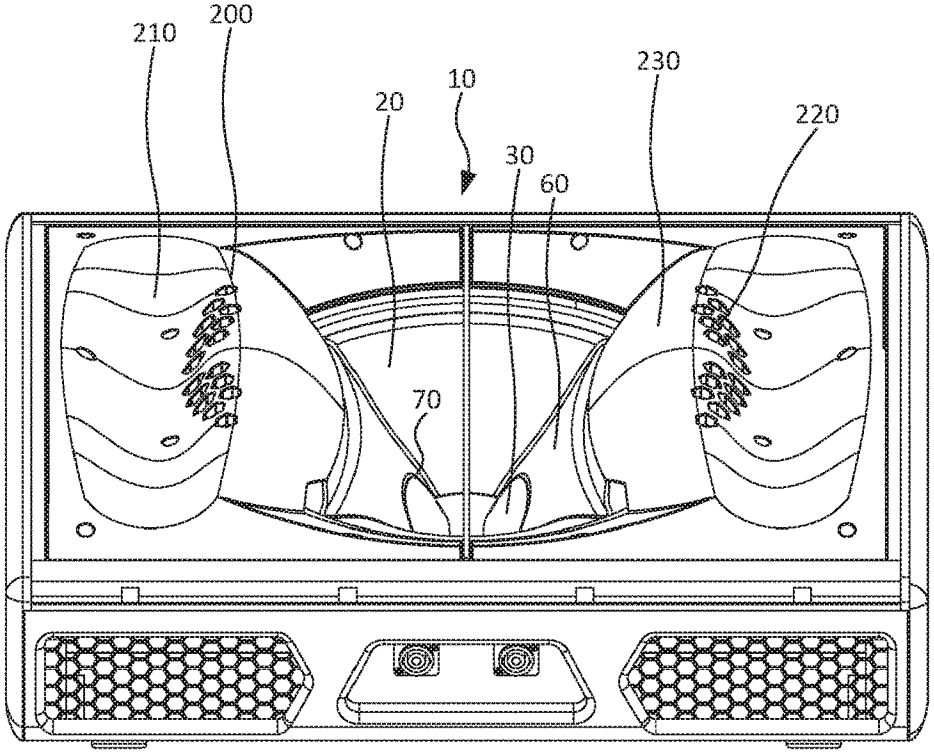
FIG. 5 are various views of a yet further examples of the coaxial loudspeaker.
Figure 5A:
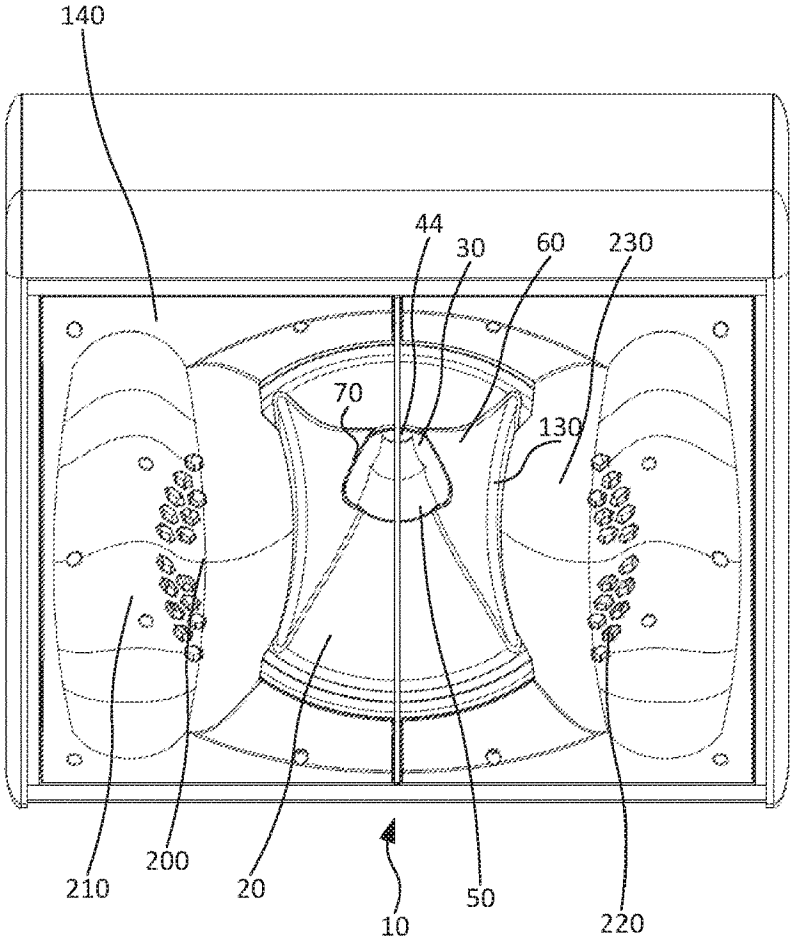
Figure 5D:
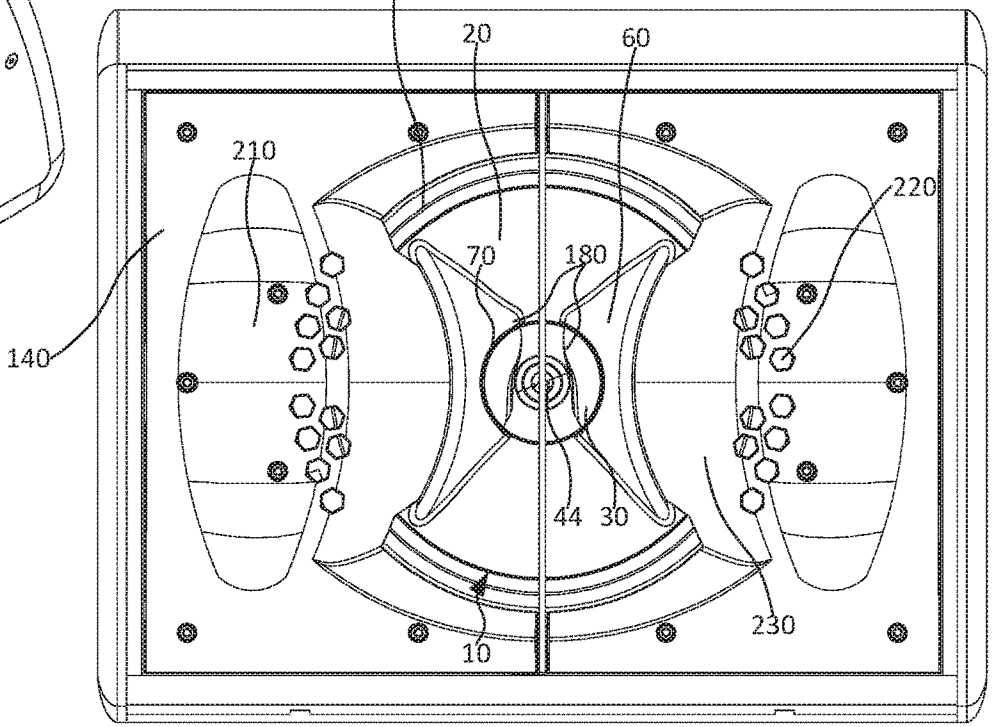
Figure 5C:
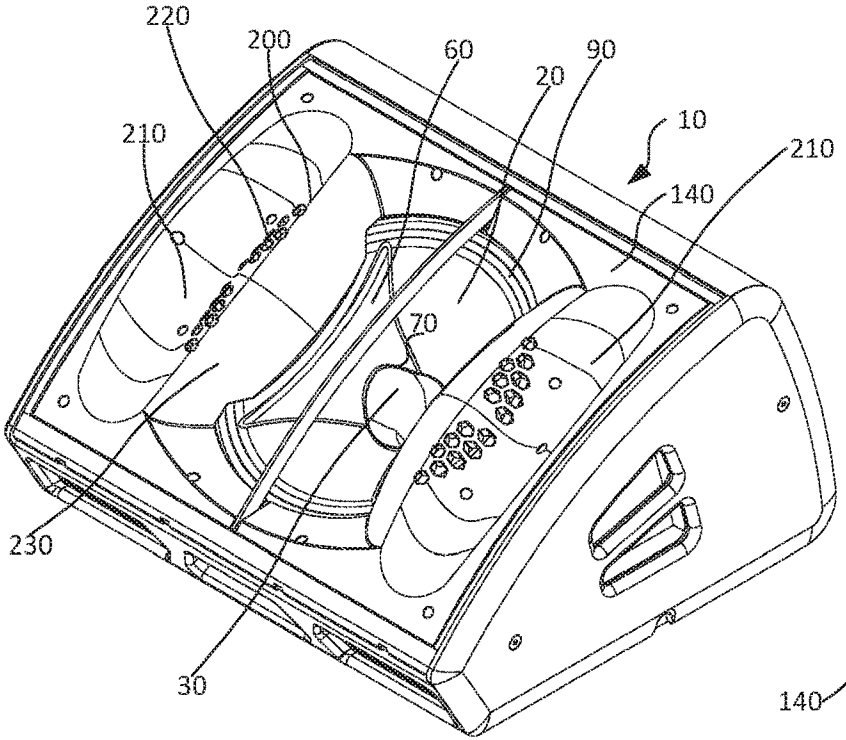

In more detail, for example the fixed waveguide 30 and the moving waveguide 60 are lobed 180 (as best seen in FIG. 5*d*). Relative to the circular base of the cone 20 (e.g. which covers the area bound by the downstream terminus of the cone), the static waveguide 100, the fixed waveguide 30 and the moving waveguide 60 cover an angular region of the imaginary circular base of less than 360°, and preferably between 15° to 150°, and more preferably 80° to 150°, that is the waveguides do not cover the entire face of the cone 20.

In this way, the present loudspeaker arrangement reduces high frequency beaming (where high frequency dispersion reduces as the frequency increases) and provides a—desirably—narrow beamwidth across the whole output of the high frequency unit. Compared to conventional coaxial speakers, the provision of an enlarged effective horn having differential dispersion as described above provides, not only a more efficient horn, but also more spectrally consistent high frequency dispersion across a broader frequency range, in particular towards the lower end of the acoustic spectrum. That is, the static waveguide 100 extends the bandwidth of directivity control of the coaxial loudspeaker 10 to a lower frequency.

For example, effective differential dispersion down to between 2 kHz, or even 1 kHz, is achieved by means of the coaxial loudspeaker 10.

In the examples shown in FIGS. 1-5, the fixed 30, moving 60 and static 100 waveguides are shaped in order to produce a substantially uniform rectangular coverage pattern by outputting wide lateral (preferably horizontally) coverage close to the loudspeaker. In this way, the consistency in frequency response and SPL—both close to the loudspeaker and further away—is more uniform than that provided by conventional loudspeakers. The improved coverage as a result of differential dispersion also means that such loudspeakers provide improved coverage using fewer loudspeakers.

As a result, it is desirable to provide as large a static waveguide 100 as possible, but without impeding the cone 20, in order to maximise the size of the effective horn mouth 120. To this end, the static waveguide is available to extend from the moving waveguide to any size in the lateral and/or downstream directions.

Provision of a Flange in the Static Waveguide

In order to minimise the effects of resonance within the cavity 170, the static waveguide 100 is provided with a flange 190 proximate to its junction with the moving waveguide.

The flange 190 complies, in the lateral and downstream directions, with the shape of the static waveguide 100. The flange 190 extends towards the cone, parallel to the moving waveguide 60 thereby forming, at the junction 130 of the static waveguide and the moving waveguide, an acoustic duct (preferably, also referred to as an "acoustic channel"). The acoustic duct reduces the effect of the cavity resonance in the cavity 170, and as a result the consistency of the SPL of the high frequency output of the coaxial drive unit is maintained.

Sinusoidal (or 'Ridged') Shaping of the Static Waveguide

In another example, as shown in FIG. 5, the static waveguide 100 comprises, beyond its most downstream point 200—its peak—a drop-off, in which the static waveguide 100 recedes upstream with increasing lateral distance from the cone 20. A substantially concave-shaped trough 210 is formed beyond the peak 200. Overall, the shape of the static waveguide 100 is therefore substantially sinusoidal.

The trough 210 is provided in order further to improve acoustic dispersion, particularly at high frequencies, by providing a beneficial diffraction effect and/or by delaying high frequency wave propagation relative to low frequency wave propagation, which prevents excessively wide throw of high-frequency components.

The acoustic effect of the trough 210 is described in more detail with reference to FIG. 15.

As shown in FIGS. 2 and 3, the static waveguide 100 overhangs directly above the cone 20.

Provision of Apertures in the Static Waveguide

In order to minimise acoustic occlusion of the cone 20, the static waveguide 100 is provided with apertures 220 through which sound from the cone 20 is able to pass. The apertures 220 are arranged directly downstream of the cone 20 and outer suspension 90, and primarily adjacent the periphery of the cone.

In another example, as shown in FIG. 5, but unlike FIG. 4, the apertures are arranged only beyond (laterally) the peak 200 of the static waveguide 100.

Since, the static waveguide 100 is arranged to improve high frequency output from the horn, in this example the static waveguide is desirably provided with a continuous surface 230—that is, without apertures—in order to guide high frequency output.

Apertures 220 are therefore instead provided on a surface of the static waveguide that is not arranged directly to guide high-frequency output, that is beyond the peak 200 of the static waveguide 100, such as within or around the trough 210.

For optimal packing density, the apertures 220 are hexagonal-shaped and dimensioned not to impede low frequency output.

Figure 7:
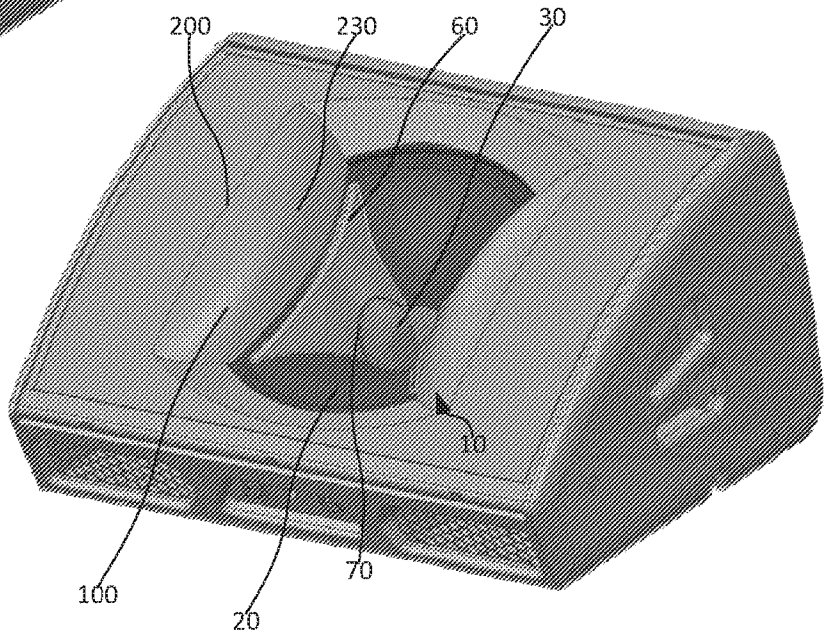
FIG. 7 shows a monitor speaker comprising an example of the coaxial loudspeaker.
Figure 8:
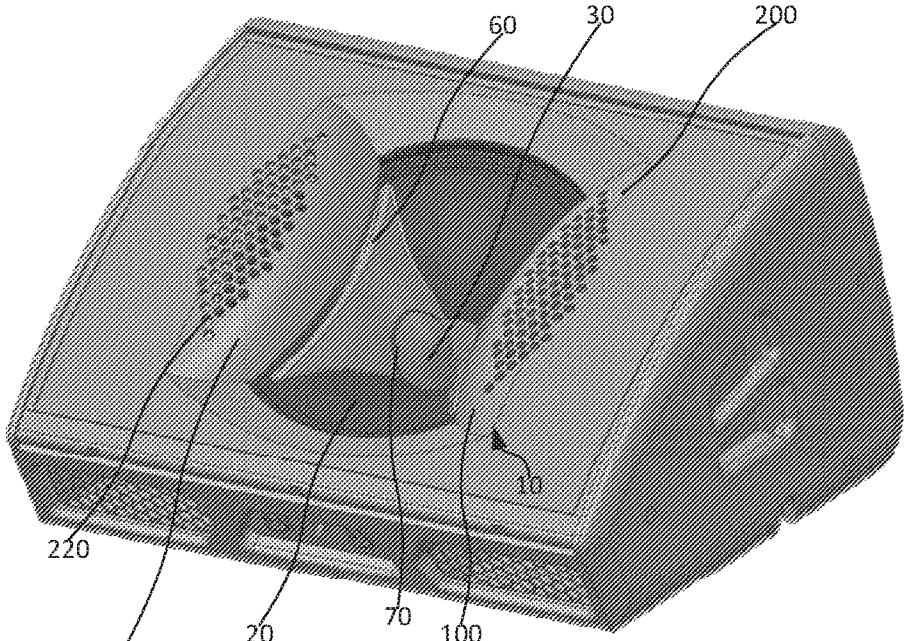
FIG. 8 shows a monitor speaker comprising a further example of the coaxial loudspeaker.

FIGS. 7 and 8 show an example of the coaxial loudspeaker 10 in which the static waveguide 100 is provided without a trough (such that the entirety of the static waveguide 100 continues the shape of the moving waveguide). The exemplary coaxial loudspeaker shown in FIG. 8 is provided with apertures 220.

FIGS. 5-9 show the coaxial loudspeaker 10 applied to a monitor (or a foldback) loudspeaker. The diameter of the cone 20 is preferably 10 cm to 50 cm, and more preferably 12 cm to 40 cm.

FIGS. 10 to 13 show a preferred form of static waveguide 100, in isolation and as applied to the cone 20.

The static waveguide 100 is formed from a solid core, for example injection moulded foam that is clad such that it is non-resonant and does not act as a physical low pass filter.

FIG. 14 show perspective underside views of the coaxial loudspeaker 10.

Figure 14A:
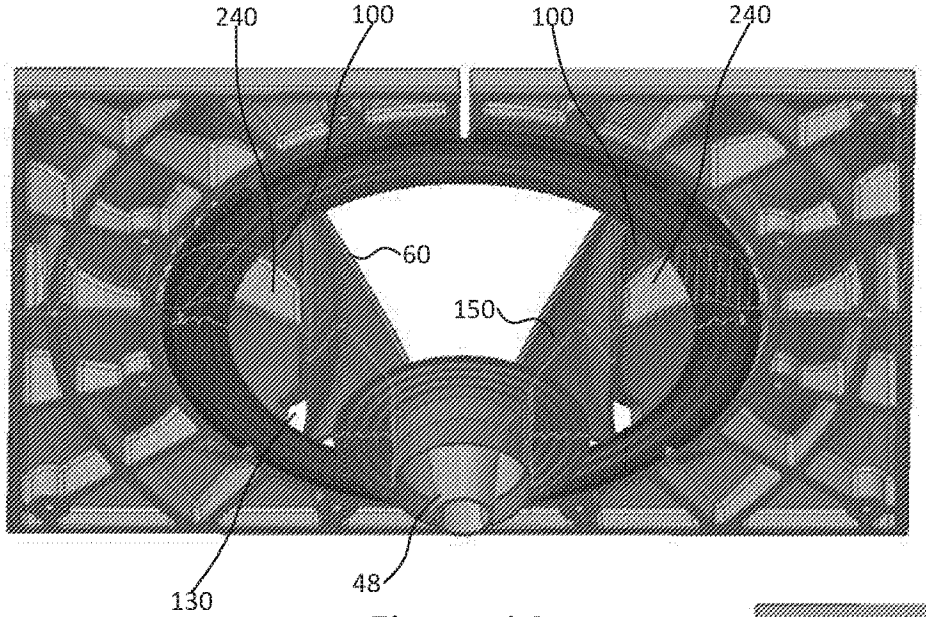
FIG. 14 show downward perspective views of the coaxial loudspeaker.

In FIG. 14*a*, the cone 20 has been removed in order to aid understanding of the cavernous shapes of the moving waveguide 60 and the static waveguide 100. The supporting rib 240 of the static waveguide is also shown.

Figure 14B:
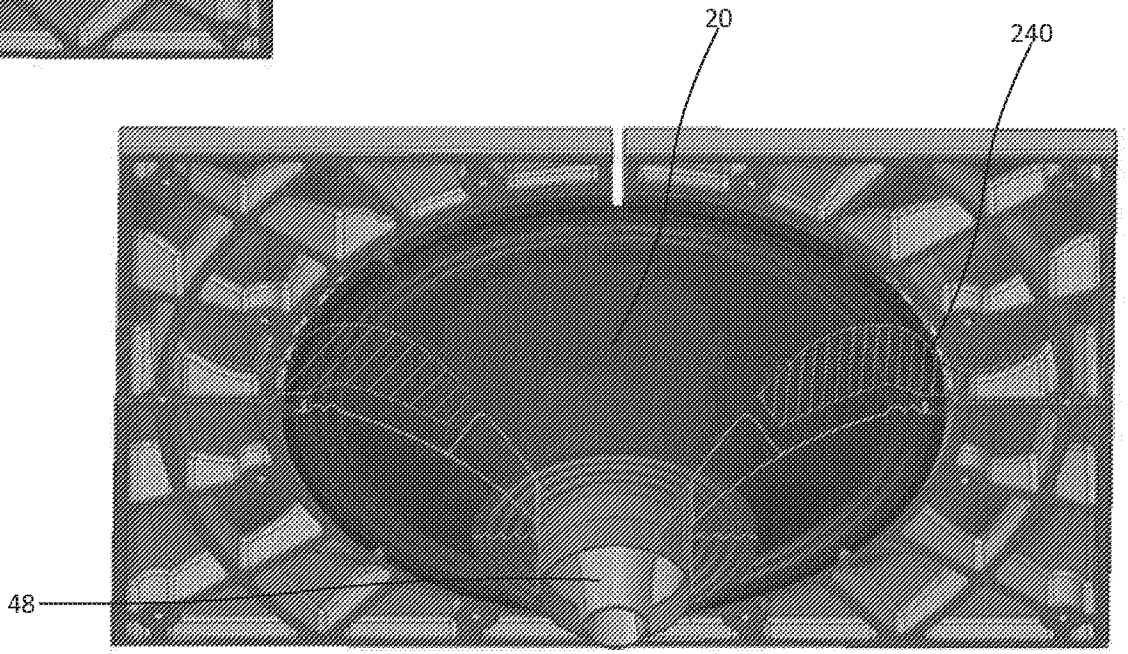

FIG. 14*b* shows the coaxial loudspeaker from the same view as in FIG. 14*a*, but with the addition of the cone 10. The fixed waveguide 30 and static waveguide 100 are also shown. The static waveguide 100 is provided as two separate, but identical, parts.

Comparative Sound Pressure Level Plots of Various Coaxial Loudspeaker Arrangements In more detail, FIGS. 15 and 16 show the acoustic effect of providing the static waveguide with a trough 210.

Figures 15A, 15B:
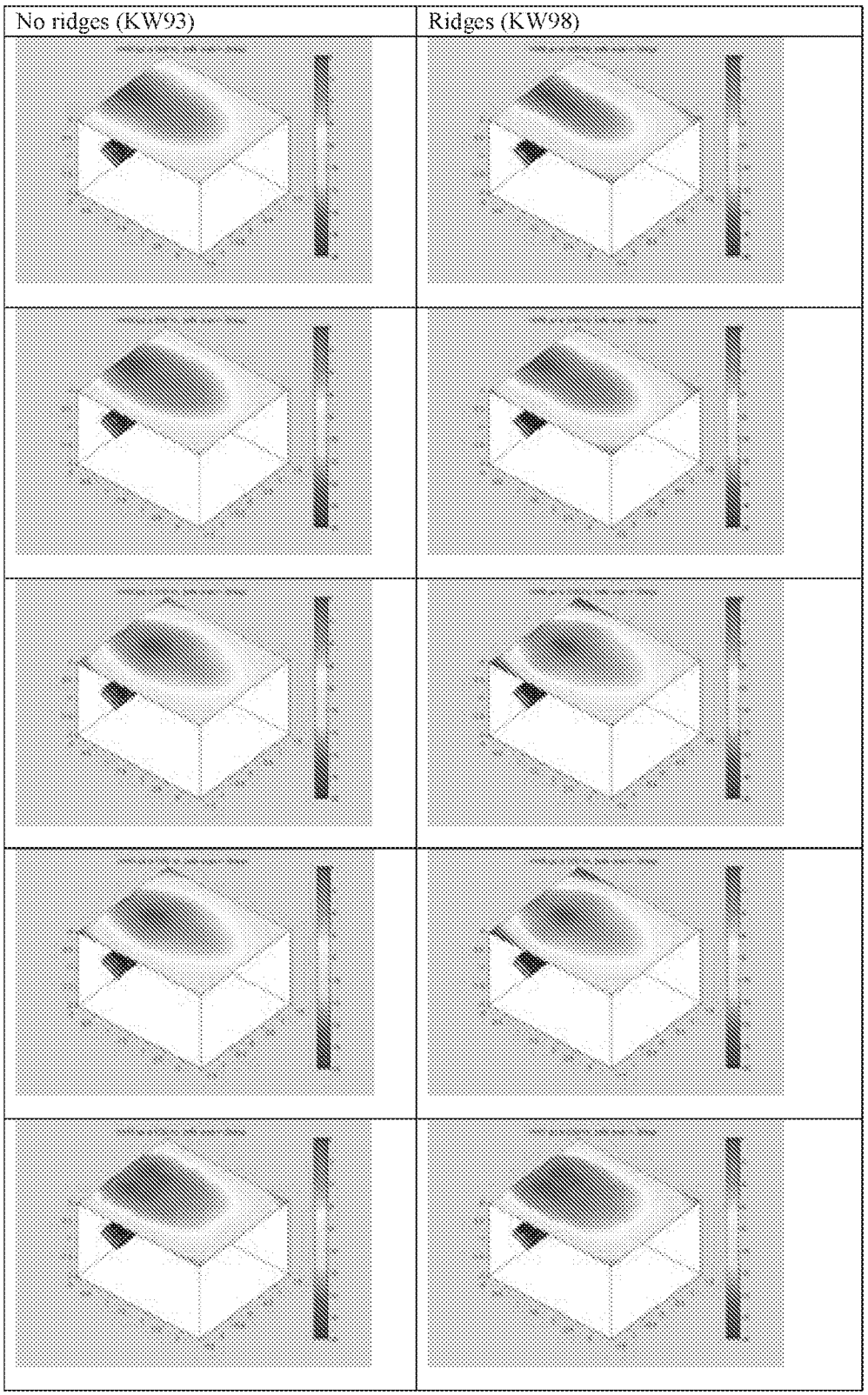
FIGS. 15 and 16 show Sound Pressure Level (SPL) plots across various frequencies, as output from different examples of coaxial loudspeakers.

With reference to FIG. 15*a*, the plots show spatial SPL with frequency from a coaxial loudspeaker 10 without a trough, but all remaining factors being the same; in this case at mid-frequencies, in particular in the region of 1.1 kHz to 5 kHz, a spatially wide (laterally) acoustic pattern is thrown.

Figure 9:
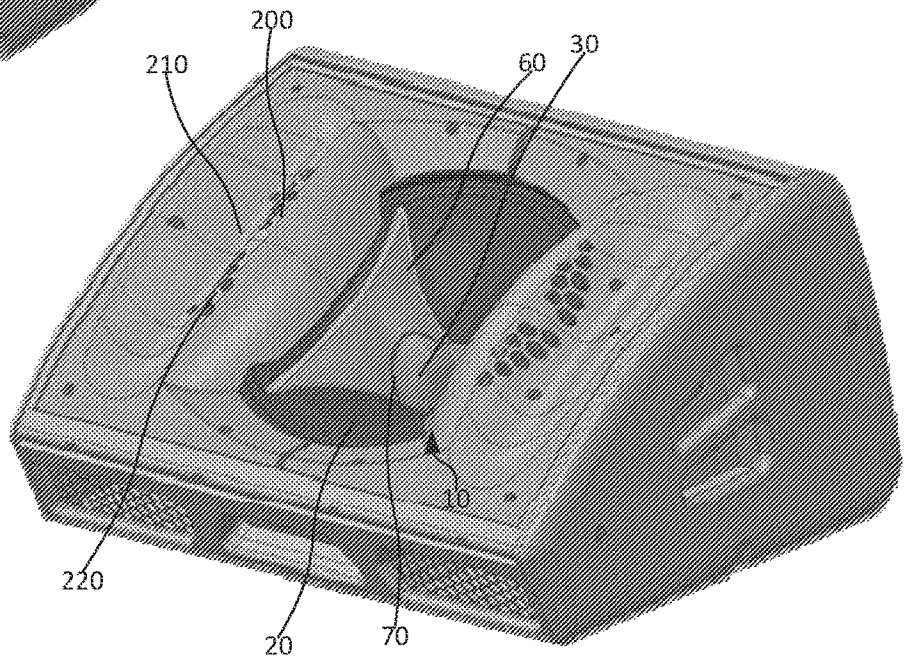
FIG. 9 shows a monitor speaker comprising a yet further example of the coaxial loudspeaker.
Figure 10:
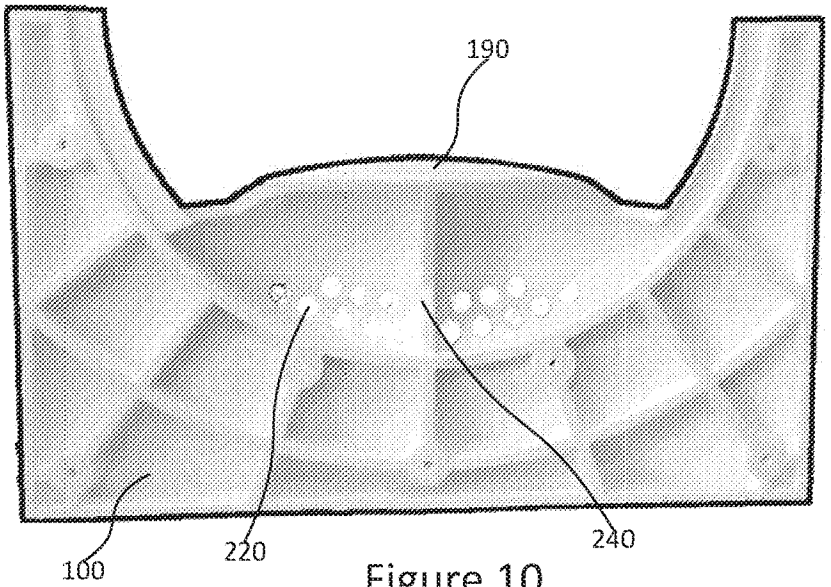
FIGS. 10 to 13 show various views of a static waveguide of a coaxial loudspeaker.
Figure 11:
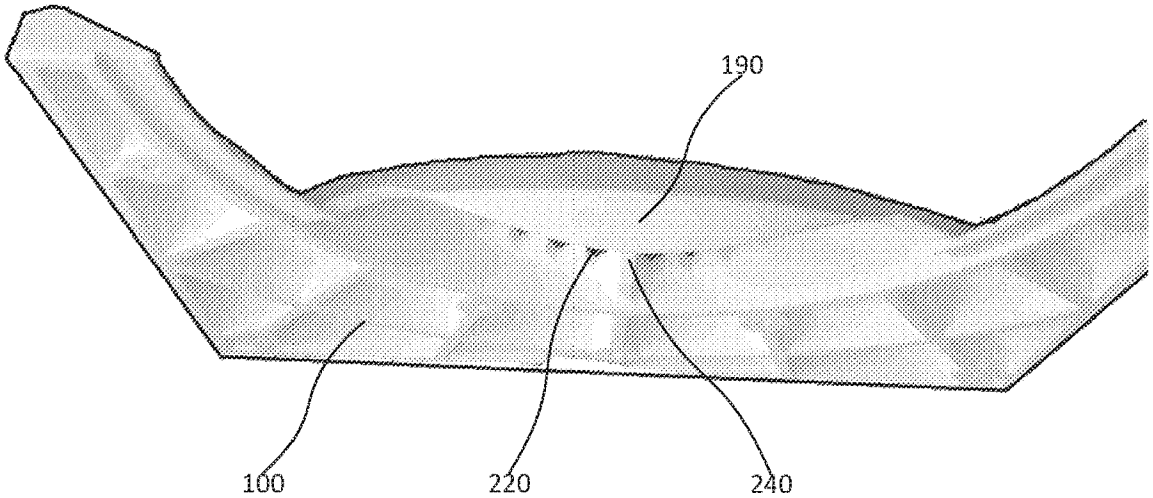
Figure 13:
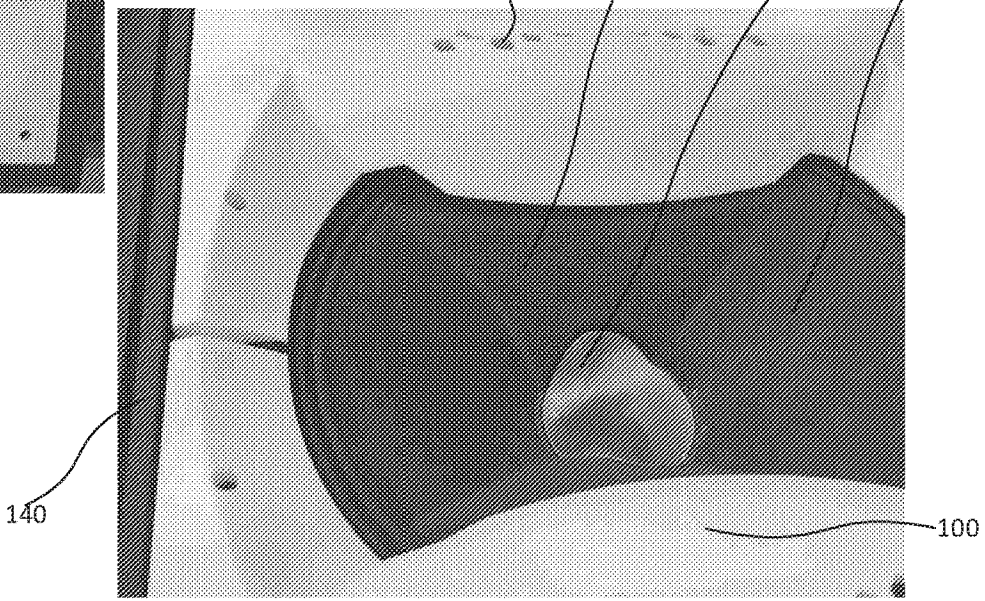
Figure 12:
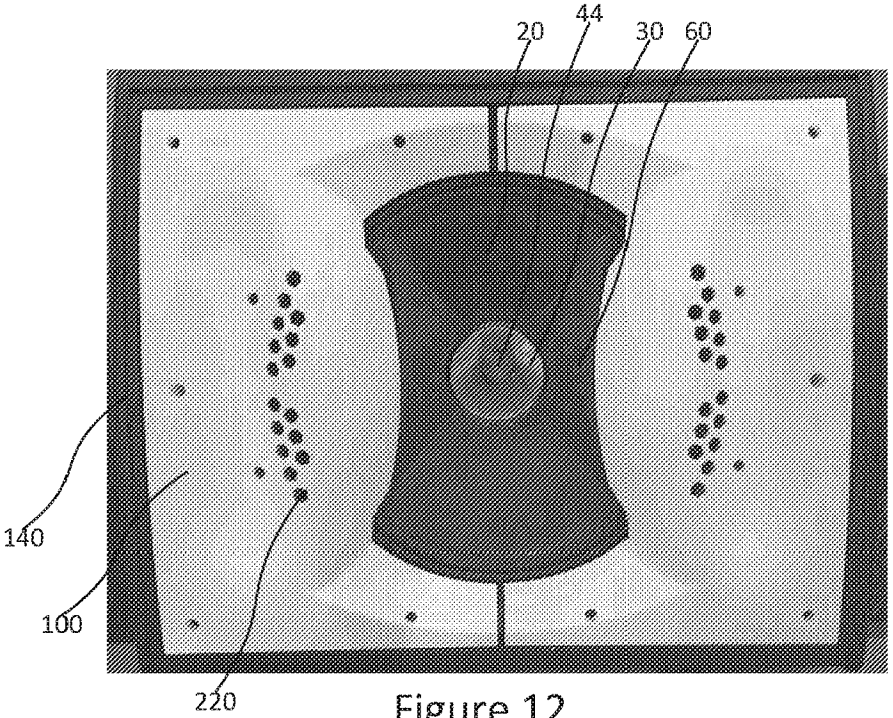

With reference to FIG. 15*b*, the plots show spatial SPL with frequency for a coaxial loudspeaker 10 as described with reference to, and as shown in, FIGS. 5 and 9, that is, in which a trough 210 is provided. The presence of the troughs facilitates, at a mid-frequency range of 1.1 kHz to 5 kHz, an improved lateral distribution of SPL, that is, more regular distribution of sound is thrown at the—crucial—mid-frequencies.

In yet more detail, FIG. 16 shows further spatial SPL plot with frequency, in which the horizontal axis indicates lateral distance (in one direction), in the listening plane, from the centre of a coaxial loudspeaker. The vertical axis indicates downstream distance. Each change of shade from white to black represents a 3 dB reduction in SPL. Each increment represents 250 mm. The SPL plots show half of the lateral listening plane, the other half is expected to be substantially symmetrical.

Figure 16A:
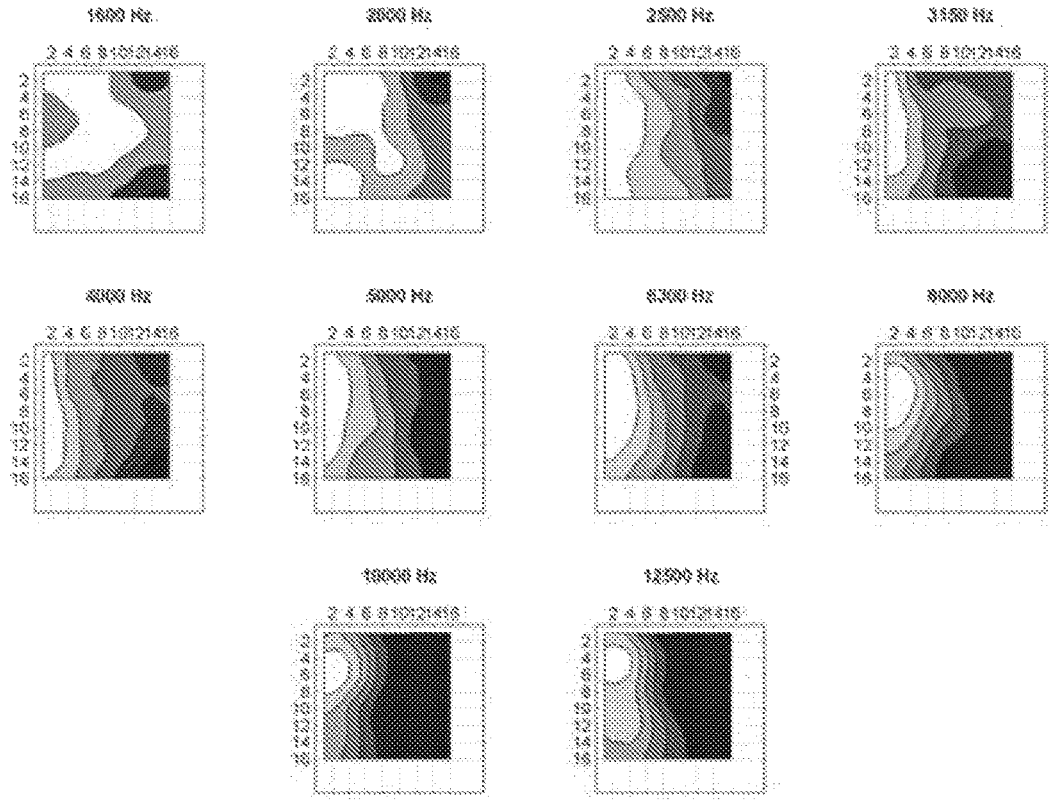

FIG. 16*a* shows output from a coaxial loudspeaker that comprises no static waveguide, but that includes fixed and moving waveguides, for example as per the coaxial speaker described with reference to FIG. 6. In this example, the directivity control reduces (coverage width increases) at 2 kHz and ceases below 2.5 kHz.

Figure 16B:
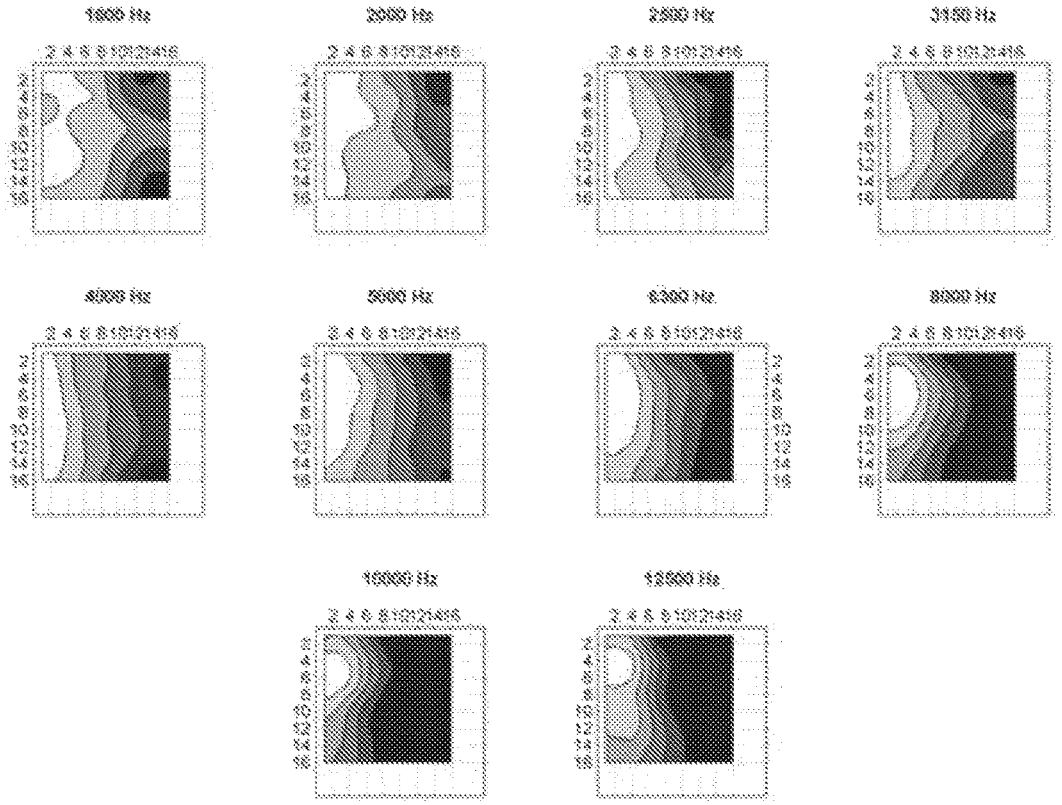

FIG. 16*b* shows output from a coaxial loudspeaker that comprises static, moving and fixed waveguides, but in which the static waveguide does not comprise a trough, for example as per the coaxial speaker described with reference to FIGS. 7 and 8. In this example, the directivity control is extended down to 1.6 kHz, but there is some widening of the coverage area at 2 kHz and 1.6 kHz compared to 2.5 kHz as shown in FIG. 16*a*.

Figure 16C:
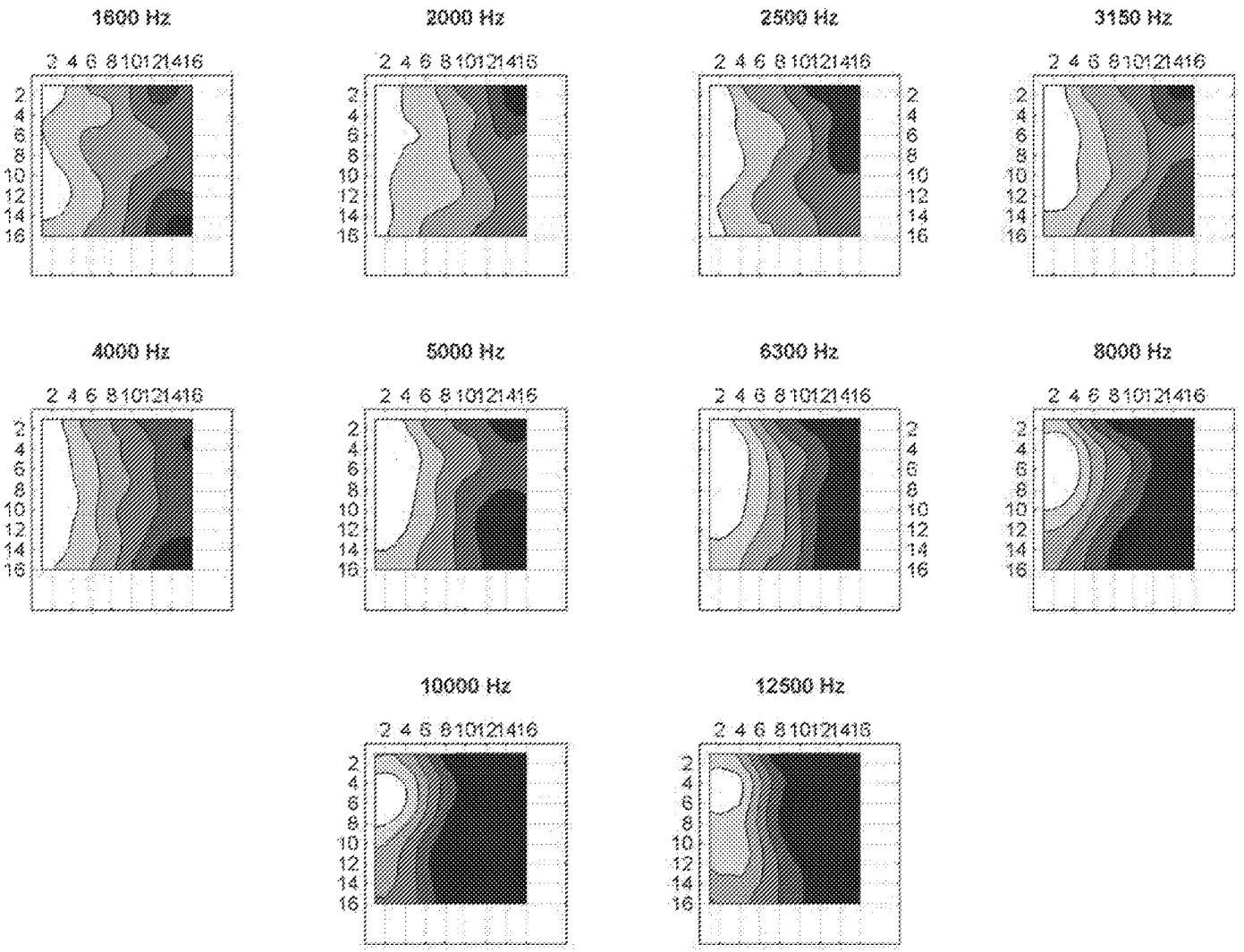

FIG. 16*c* shows the output from a coaxial loudspeaker that comprises a static waveguide having a trough 210, and also comprising moving and fixed waveguides, for example as per the coaxial speaker described with reference to FIGS. 5 and 9. In this example, the directivity control is extended down to 1.6 kHz and the width of the coverage area is more consistent compared with the higher frequencies than the outputs shown in FIGS. 16*a* and 16*b*.

Alternatives and Modifications

In an alternative example, the static waveguide is provided as a separate and standalone structure that can be arranged to extend the moving waveguide without coupling to the loudspeaker cabinet.

Although the coaxial loudspeaker arrangement is shown as applied to a monitor loudspeaker (also referred to as a foldback loudspeaker) in FIGS. 5 to 9, this arrangement is available to be applied to any form of coaxial loudspeaker.

In one alternative, the shape of the waveguides is determined by extrapolating the curvature of the immediately preceding (in the direction towards the horn) waveguide.

The loudspeaker apparatus 10 is arranged to affect the output of the loudspeaker apparatus 10 differentially across the output frequency spectrum (for example, such that a non-axisymmetric high frequency coverage pattern is output) and/or the output SPL with position relative to an axis perpendicular to the downstream direction 122. In one example, the shape of the static waveguide 100, moving waveguide 60 and/or the fixed waveguide 30 is adapted to achieve any desired manipulation of sound from the cone and/or high frequency unit, and so take any suitable form suitable for this purpose. For example, the fixed waveguide 30 is a differential acoustic dispersion horn. Other types of horn, such as, but not limited to, constant directivity, diffraction slot horns, multicell, radial, sectoral, bi-radial and twin Bessel horns are also used. The geometry of the cone 20 takes the form of a straight and/or curved, e.g. convex, (truncated) cone.

In one example, the high frequency unit does not comprise a compression driver, but a convex dome (or a direct radiating dome) instead, preferably with a suitable phase corrector (also known as a phase plug) mounted into a fixed horn.

As shown in FIGS. 6-9, the moving waveguide 60 forms a pocket 250 with the cone, rather than an enclosed cavity (as per FIG. 2).

It will be understood that the present invention has been described above purely by way of example, and modifications of detail can be made within the scope of the invention.

Each feature disclosed in the description, and (where appropriate) the claims and drawings may be provided independently or in any appropriate combination.

Reference numerals appearing in the claims are by way of illustration only and shall have no limiting effect on the scope of the claims.

The invention claimed is:

1. A coaxial loudspeaker apparatus comprising:

a first unit, being arranged to propagate sound in a first frequency range;

a second unit, being arranged to propagate sound in a second frequency range that is higher than the first frequency range, comprising a first waveguide;

a second waveguide arranged to extend substantially in prolongation of the first waveguide; and a third waveguide arranged to extend substantially in prolongation of the second waveguide.

2. An apparatus according to claim 1, wherein the second waveguide is provided on, and preferably bonded to, the first unit;

and/or wherein the second waveguide and the third waveguide are respectively arranged to extend substantially in prolongation of the first waveguide and second waveguide in a downstream direction;

and preferably wherein the first unit is also arranged to extend substantially in prolongation of the first waveguide in a downstream direction.

3. An apparatus according to claim 1, wherein the first waveguide and the third waveguide are fixed;

and/or wherein the second waveguide is arranged to move relative to the first waveguide and/or relative to the third waveguide.

4. An apparatus according to claim 1, wherein the third waveguide extends substantially continuously from the second waveguide and wherein the second waveguide extends substantially continuously from the first waveguide;

preferably wherein the first unit also extends substantially continuously from the first waveguide;

more preferably wherein the second waveguide is arranged to move in unison with the first unit in operation.

5. An apparatus according to claim 1, wherein the first waveguide, second waveguide and/or the third waveguide are coaxial.

6. An apparatus according to claim 1, wherein the first unit comprises a cone and wherein the second unit comprises a driver unit that is arranged upstream of the cone;

and/or wherein the second waveguide is provided on, and preferably bonded to, the cone;

and/or wherein the first unit comprises only one cone; and preferably wherein the second unit comprises a horn, a dome and/or a cone.

7. An apparatus according to claim 1, wherein the third waveguide is arranged to extend substantially in prolongation of at least a portion of the first unit;

preferably wherein the third waveguide comprises a convex-shaped lip;

more preferably wherein the convex-shaped lip overhangs directly downstream of the first unit;

yet more preferably wherein the first waveguide comprises a mouth located at a junction with the second waveguide; a throat located acoustically upstream; and a passage extending between the mouth and the throat.

8. An apparatus according to claim 1, wherein the third waveguide includes at least one aperture for allowing sound from the first unit to pass through the third waveguide;

preferably wherein the at least one aperture is arranged directly downstream of the first unit; and more preferably wherein every aperture is arranged directly downstream of the first unit.

9. An apparatus according to claim 1, wherein the third waveguide extends, in the downstream direction, laterally away from the second unit;

preferably wherein the third waveguide further comprises a peak at a most downstream point of the third waveguide.

10. An apparatus according to claim 1, wherein the third waveguide further comprises a trough extending in an upstream direction, laterally away from the peak and from the second waveguide.

11. An apparatus according to claim 1, wherein the third waveguide comprises a peak, wherein the peak is the most downstream point of the third waveguide that is local to or most proximate to the second unit.

12. An apparatus according to claim 1, wherein the third waveguide is provided with a smooth and continuous surface, preferably extending at least from a junction between the third waveguide and the second waveguide and extending to the peak.

13. An apparatus according to claim 1 wherein the third waveguide includes at least one aperture and the at least one aperture is provided on the third waveguide laterally away from the peak and the second unit, and preferably the at least one aperture is only provided on the third waveguide laterally away from the peak and the second unit;

and/or wherein the at least one aperture is provided on the trough, and preferably only on the trough.

14. An apparatus according to claim 1, wherein the third waveguide and the second waveguide are separated;

preferably wherein the third waveguide is arranged such that the third waveguide does not prevent travel of the first unit and/or the second waveguide;

more preferably wherein the third waveguide is separated from the second waveguide across their junction by a constant distance.

15. An apparatus according to claim 1 comprising a cavity in a region bound by the first unit, the second waveguide and the third waveguide.

16. An apparatus according to claim 1, wherein the third waveguide comprises a flange arranged opposite the second waveguide, thereby arranged to provide an acoustic duct connecting the cavity with a region outside of the cavity and downstream of the second waveguide;

preferably wherein the second waveguide is arranged as a portion of a truncated conical surface;

more preferably comprising a hollow region between the cone and the second waveguide, preferably wherein the hollow region is entirely enclosed;

and/or wherein the flange extends towards the cone and parallel to the second waveguide.

17. An apparatus according to claim 1, comprising a cavity in a region bound by the first unit, the second waveguide and the third waveguide thereby providing an acoustic duct wherein the acoustic duct is arranged to reduce resonance within the cavity.

18. An apparatus according to claim 1, wherein the second waveguide is less dense than the moving parts (preferably the cone) of the first unit;

preferably wherein the second waveguide and/or the first unit is formed from paper, fibreglass, fabric and/or composite materials;

and/or wherein the third waveguide is denser than the second waveguide.

19. An apparatus according to claim 1, comprising at least two: first waveguides; second waveguides; and/or third waveguides;

and/or wherein the at least two first waveguides, the at least two second waveguides and/or the at least two third waveguides are arranged on a plane that bisects the first unit;

and/or wherein the at least two second waveguides and the at least two third waveguides are arranged on opposite lateral sides of the second unit.

20. An apparatus according to claim 1, wherein the first waveguide, second waveguide and/or third waveguide are axially asymmetric;

preferably wherein the first waveguide, second waveguide and/or third waveguide are shaped to produce differential acoustic dispersion.

21. An apparatus according to claim 1, wherein the second unit comprises an effective mouth provided by a lateral distance between the peaks of the static waveguide.

22. An apparatus according to claim 1, wherein the first unit, preferably the cone, is the most downstream sound reproducing member of the apparatus;

preferably wherein the second unit is the most upstream sound reproducing member of the apparatus;

more preferably in which sound reproducing members of the apparatus consist only of the first and second units;

yet more preferably wherein the first unit is anchored to a part of the apparatus other than the third waveguide, and preferably other than the first waveguide also.

23. An apparatus according to claim 1, wherein the most proximate parts of the first and third waveguide are laterally set apart from one another, preferably by a distance that is at least equal to the lateral extent of the second waveguide.

24. A loudspeaker incorporating the coaxial loudspeaker apparatus according to claim 1, preferably wherein the loudspeaker is arranged as a monitor speaker.

25. A waveguide member for a coaxial loudspeaker comprising a first waveguide and a second waveguide extending substantially in prolongation of the first waveguide, said waveguide member being arranged to extend substantially in prolongation of the second waveguide, preferably the waveguide member being the third waveguide of claim 1;

and/or wherein the waveguide member is arranged to be fixed relative to the second waveguide, preferably wherein the waveguide member is fixed directly to the coaxial loudspeaker;

and/or wherein the waveguide member include at least one aperture for allowing sound from the coaxial loudspeaker to pass through the third waveguide;

and/or wherein the waveguide member comprises a peak at a most downstream point of the third waveguide;

and/or wherein the waveguide member comprises a trough extending in an upstream direction, laterally away from the peak and from the second waveguide;

and/or wherein the waveguide member is provided in two separate parts, preferably wherein the parts are identical;

and/or wherein the waveguide member is provided with a flange for forming an acoustic channel with the second waveguide when the waveguide member is in situ such that it extends substantially in prolongation of the second waveguide.

* * * * *